United States Patent [19]

Linetsky

[11] 4,286,934

[45] Sep. 1, 1981

[54] PRECAST HOUSE MANUFACTURING AND ERECTING PLANT

[76] Inventor: Mikhail Linetsky, #94-276 Adsum Dr., Winnipeg, Manitoba, Canada, R2P 0W2

[21] Appl. No.: 111,933

[22] Filed: Jan. 14, 1980

[51] Int. Cl.[3] ..... B28B 1/00

[52] U.S. Cl. ..... 425/62; 425/63

[58] Field of Search ..... 425/62, 63, 88, 453, 425/454; 249/1, 20, 26, 27, 160, 170, 171, 172, 188, 207, 209, 210, 212, 184, 186, 83

[56] References Cited

U.S. PATENT DOCUMENTS

| | | | |
|---|---|---|---|
| 934,768 | 9/1909 | Talbot | 425/63 X |
| 1,134,543 | 4/1915 | McArthur | 425/63 |
| 1,563,798 | 12/1925 | Sargeant | 425/63 |
| 1,596,868 | 8/1926 | Bryholdt | 425/62 |
| 2,489,607 | 11/1949 | Alexander | 249/171 X |
| 2,870,518 | 1/1959 | Bossner | 425/63 |
| 3,234,620 | 2/1966 | Short | 425/62 |
| 3,320,646 | 5/1967 | Wilkins | 425/62 |
| 3,659,977 | 5/1972 | Haws | 425/63 X |
| 3,724,805 | 4/1973 | Kleiber et al. | 249/171 |
| 3,847,341 | 11/1974 | Strikler | 249/27 |
| 3,847,521 | 11/1974 | Strikler | 249/27 X |

*Primary Examiner*—Donald E. Czaja
*Assistant Examiner*—James R. Hall

[57] ABSTRACT

A portable plant for on-site horizontal casting and erecting concrete wall panels and roof slabs of bays with variable widths and heights to form one-story, split-level and two-story houses and other buildings.

The plant embodies two rotatable form-erectors for casting and erecting longitudinal bearing wall panels, a lifting form for casting and erecting roof slabs and a rotatable form-stripper for casting and erecting cross wall panels.

The casting and erecting equipment is mounted either on a truck or a rail car.

In order to meet the highway movement restrictions, the lifting form and form-stripper can be folded. The form-erectors have several versions of their design and mutual arrangement. These versions give five modifications of the plant.

The maximum overall cross dimensions of the plant in a travelling position do not exceed 3.6 m (12 ft.) in width and 3.9 m (13 ft.) in height.

5 Claims, 10 Drawing Figures

PRECAST HOUSE MANUFACTURING AND ERECTING PLANT

BACKGROUND OF THE INVENTION

This invention relates to molding and erecting systems utilized in precast concrete construction.

Existing methods of precast construction require numerous cranes for producing, handling and erecting panels.

A machine for producing and erecting wall and roof panels without the use of cranes has been proposed heretofore.

It is disclosed in the application to the U.S. Patent Office—"Casting and Erecting Machine," Ser. No. 7,653, filed on Jan. 29, 1979 U.S. Pat. No. 4,207,042 June 10, 1980 by M. Linetsky.

That machine, having the casting and erecting equipment mounted on a rail car, includes a solid shallow lifting mould with the width being less than the distance between the erected wall panels.

After the roof slab is erected, the mould is placed over the vertically positioned form-erectors. On one hand, such design makes the mould simple, but on the other hand, it is necessary to use a special detachable edge on each form-erector that creates straitened conditions while stripping the mould and requires close tolerance, that makes it difficult to use a truck-mounted version of the machine. Besides, the design of the mould does not provide manufacturing roof slabs with full width and thickness.

Another drawback of the machine is the possibility of erecting only single-storey bays with a constant width in clear, which does not exceed the highway movement restrictions.

BRIEF SUMMARY OF THE INVENTION

This invention represents a series of modifications of the plant consecutively improving the mentioned machine.

It is a primary object of this invention to eliminate the straitened conditions in operating the plant while erecting the roof slabs and stripping the lifting form.

It is also an object of this invention to eliminate the detachable edge of complicated design on each form-erector.

It is another object of this invention to erect the bays with variable widths by the plant of any modification to meet possible deviations in regards to cross position of the plant concerning the foundations and to form the buildings with broken-line configuration by lapping the longitudinal wall panels each by the other.

It is further an object of this invention to erect the bays the width of which exceeds the maximum allowable highway width.

Finally, it is an object of this invention to erect the bays with variable heights reaching two storeys.

These advantages are achieved by using a folding design of the lifting form and form-stripper, and several designs of the form-erectors. These designs create five following modifications of the plant.

Type I a plant with the symmetrically set form-erectors, which, due to a special detachable edge, have the width in the cross direction less than the height of the wall panels, and staying in a vertical position after erection and during travelling of the plant.

Type II the same as type I, except the special detachable edge, eliminated by producing the roof slabs with a special shape of the bottom surface.

Type III the same as type II, except the form-erectors rotate back into the horizontal position after erection, but are positioned vertically during travelling of the plant.

Type IV a plant with the form-erectors set in different levels, lapping one over the other, rotating back into the horizontal position and staying in such position during travelling of the plant.

Type V a plant with the form-erectors extended in cross direction, overlapping one another. After erection, they are folded and stay in a vertical position.

All the modifications can have both the truck and rail car mounted versions.

A better understanding of the present invention will be derived by reference to ensuing specification and accompanying drawings wherein:

DETAILED DESCRIPTION OF THE INVENTION

Figure 1:
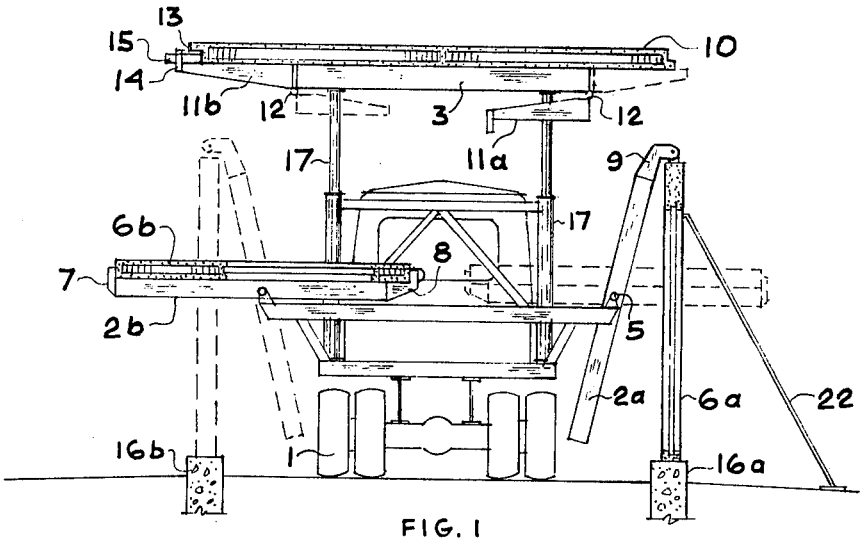
FIG. 1 is a cross-sectional view of the plant type I, showing erection of the longitudinal bearing wall panels.

Referring now to the drawings, the plant of the present invention embodies as a base, a wheeled frame 1, which can be represented either by a truck or a rail car.

The frame 1 supports the following casting and erecting equipment of the plant: two form-erectors 2*a* and 2*b*, rotatable able parallel to the lengthwise axis of the frame 1, a lifting form 3, and a form-stripper 4, rotatable across the lengthwise axis of the frame 1.

Figure 2:
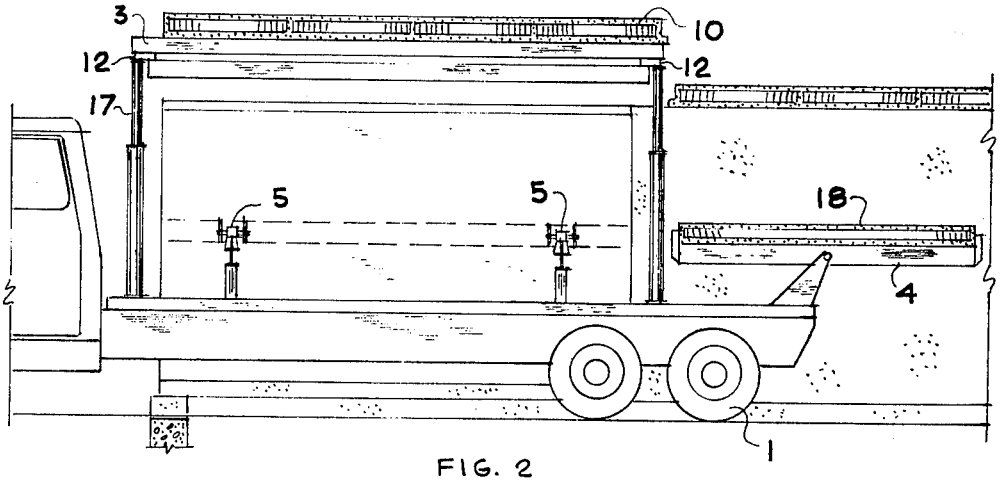
FIG. 2 is a longitudinal sectional view of the plant types I–IV, showing erection of the roof slab.

The invention includes five modifications of the plant. Type I of the plant is shown in drawing FIGS. 1, 2 and 3. The form-erectors 2*a* and 2*b* are symmetrically set on the frame 1 and rotate around a horizontal axis through hinges 5, dividing each form-erector into two parts. The part which becomes the top one after rotating, functions as a jib during erection of the longitudinal bearing wall panels 6a and 6b; the opposite part of the form erector in this case is a counterpoise.

All edges of the form-erectors and the form-stripper are detachable and may be taken away before rotating.

Normally, the outline of longitudinal bearing wall panels 6a and 6b coincides with edges 7 on both sides and bottom (after rotating) of the form-erectors.

According to the important aspect of this modification, an edge 8 on each form-erector, which would have become the top one after rotating and would be replaced by two brackets 9, has a special design, so that the wall panels 6a and 6b *l in the horizontal position are wider than the form-erectors. Thus, the top of the installed wall panels 6a* and 6b is higher than the top of the stripped form-erectors, being in a vertical position. Some gap between the flat bottom surface of the erected roof slab 10 and the top of the stripped form-erectors, that is necessary for moving the plant, is ensured. The lifting form 3 has hinged parts 11a and 11b, each situated on both sides parallel to the lengthwise axis of the frame 1, and rotatable around a horizontal axis through hinges 12.

To meet the highway movement restrictions, the plant travels with the lifting form being folded. The parts 11a and 11b are turned down and situated under the lifting form.

Before pouring the concrete, the lifting form 3 unfolds, and the parts 11a and 11b are turned up. Side edges 13 of the lifting form are installed on the parts 11a and 11b through a holder 14 and a bar 15 with a slot, so that the edges 13 can be fixed in an appropriate position to meet possible deviations of the plant concerning foundations 16a and 16b, and to erect the bays with variable widths. Fixing the cross edges of the lifting form is similar to that of the side edges.

Lifting and lowering of the lifting form is carried out with jacks 17.

The form-stripper 4 may have the same width in a horizontal position as a cross wall panel 18.

Figure 3:
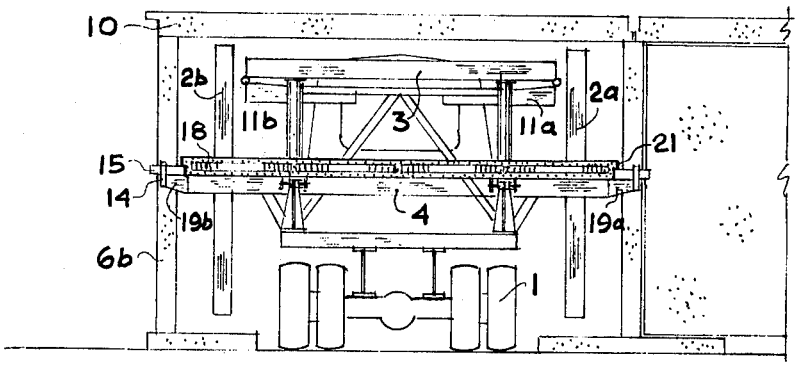
FIG. 3 is a cross-sectional view of the plant type I, showing the form-stripper before erecting the cross wall panel.
Figure 4:
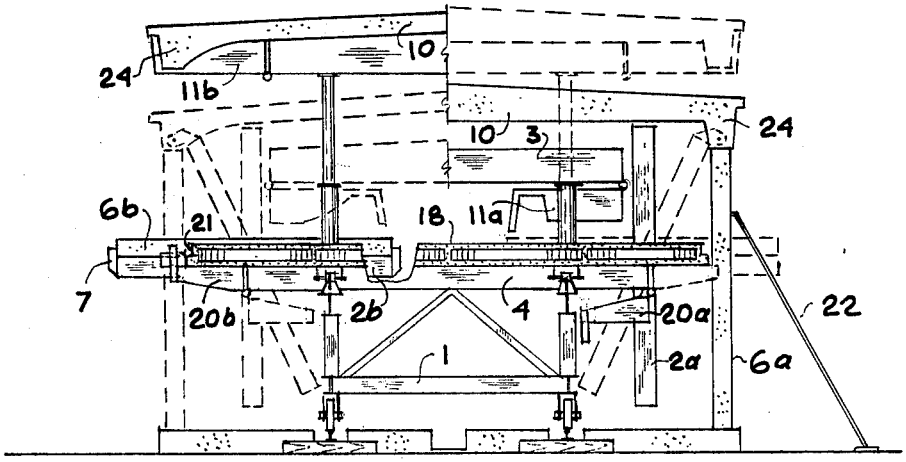
FIG. 4 is a cross-sectional view of the plant type II, showing extreme positions of the form-erectors and lifting form.
Figure 5:
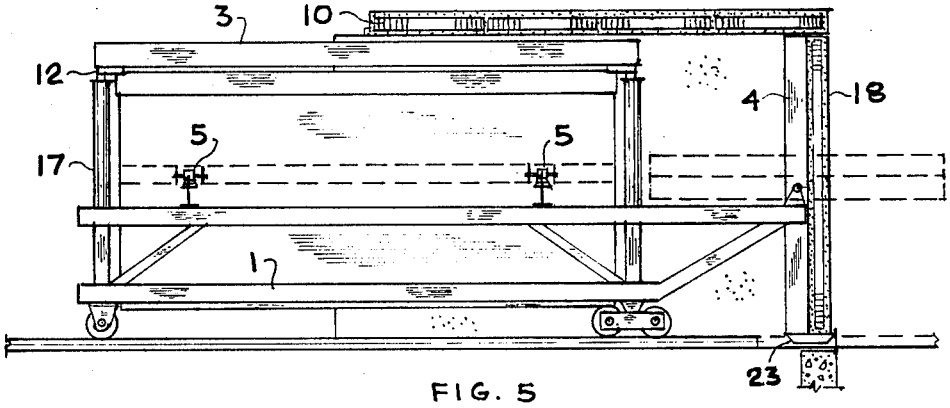
FIG. 5 is a longitudinal sectional view of the plant types I–IV, showing erection of the cross wall panel.

The length of the form-stripper is as big as reasonable for the plant to move through the bay with the minimum width. On both sides of the form-stripper there are either detachable end parts 19a and 19b, as shown in FIG. 3, or hinged parts 20a and 20b, as shown in FIG. 4. In both cases, fixing side edges 21 on the form-stripper is carried out with the same method as with the edges 13, fixed on the hinged parts 11a and 11b of the lifting form.

Erection of the bay starts with the longitudinal bearing wall panels 6a and 6b. Following this, the form-erectors 2a and 2b are rotated more than 90°, the panels 6a and 6b are stripped, being hung on the brackets 9 through lifting loops, installed on the foundations 16a and 16b, and braced with clamps 22. After that, the form-erectors are in a vertical position.

Then the lifting form 3 erects the roof slab 10. With this arrangement, the lifting form, being in the folded position, goes down, and the roof slab is put down on the wall panels 6a and 6b.

After that, the plant erects the cross wall panel 18 with the form-stripper 4. Following this, a hinged lock bracket 23 is fixed in a working position on the side of the form-stripper, which is the bottom side after rotating; the panel 18 is fastened to the form-stripper to prevent overturning; the form-stripper is rotated into a vertical position, the plant moves to put the panel 18 into the project position; and after the panel 18 is fixed to the wall panels 6a and 6b, the bracket 23 releases the panel 18, and the plant moves away.

The type II of the plant shown in FIG. 4, differs from the type I by design of the form-erectors and roof slabs. To avoid using the detachable edges 8 with the special configuration, the wall panels 6a and 6b have the same height as the width of the form-erectors 2a and 2b in the cross direction. The gap between the top of the stripped form erectors and the bottom face of the roof slab 10 is formed by a special configuration of the latter. Such configuration occurs when using a support edge 24 of the roof slab lower than its bottom surface over the stripped form erectors. The examples are: on the right side of the drawing, the support edge 24 has a shape of a rib; on the left—the support edge 24 is formed by an oval shape of the bottom surface of the roof slab.

Figure 6:
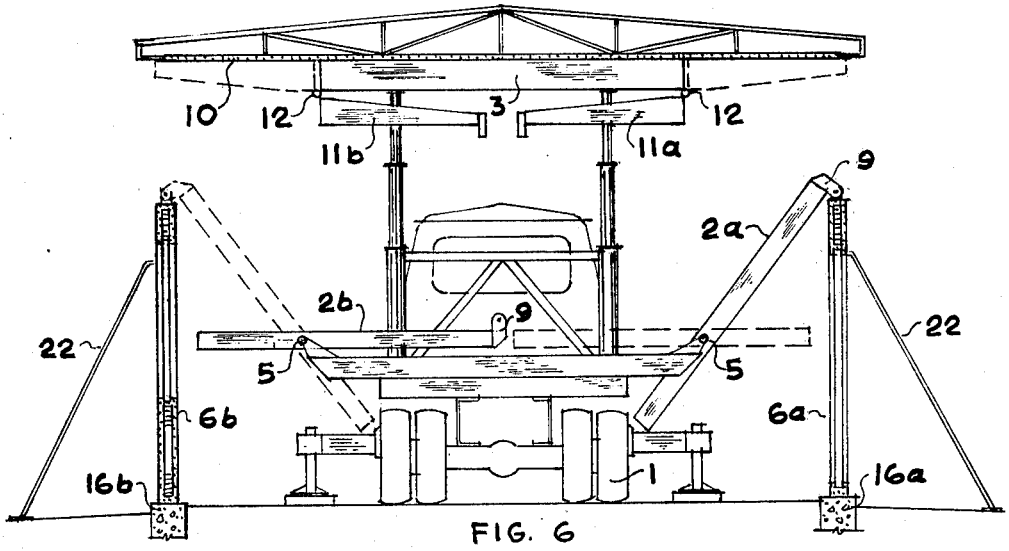
FIG. 6 is a cross-sectional view of the plant type III, showing erection of the longitudinal bearing wall panels.

The modification of the plant type III, shown in FIG. 6, is characterized by using both the form-erectors 2a and 2b, having the width (in the horizontal position), equal to the whole story height of the wall panels 6a and 6b, and the roof slab 10 with the flat bottom surface. After erection, the stripped form-erectors rotate back into the horizontal position.

With ths arrangement, the hinges 5 are located out of centre, so that the part of the form-erectors functioning as a jib, is considerably longer than the part being a counterpoise. That is, if the wall panels 6a and 6b are erected at sufficiently enough distance from each other, the form-erectors get enough room to rotate back into the horizontal position.

Figure 7:
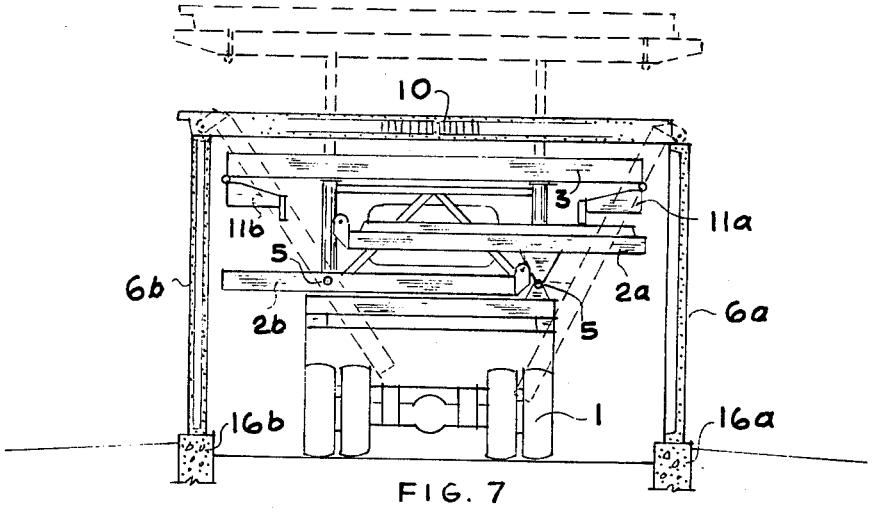
FIG. 7 is a cross-sectional view of the plant type IV after erection of the roof slab.

The modification of the plant type IV, shown in FIG. 7, comprises one more design of the form-erectors by setting them at different levels and shifting them one to the other, so that the form-erector 2a overlaps the form-erector 2b. After erecting, the form-erectors rotate back into the horizontal position and stay in such position during transportation.

Figure 8:
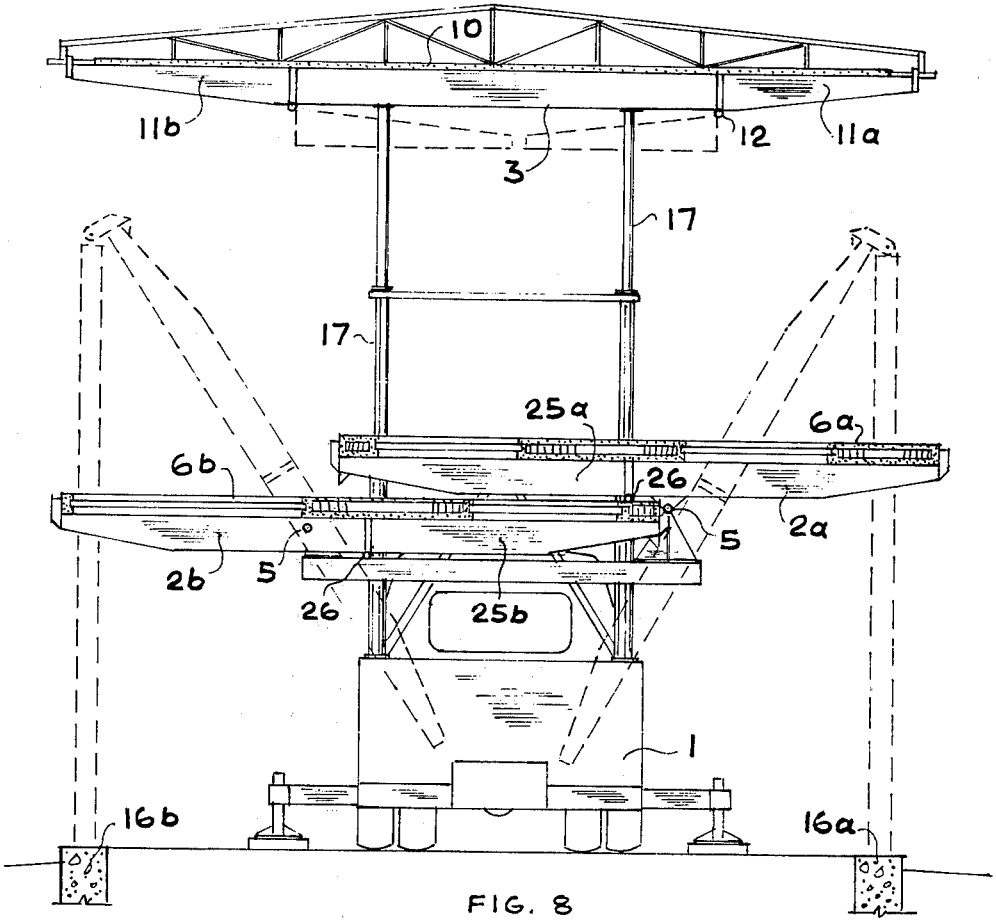
FIG. 8 is a cross-sectional view of the plant type V, showing erection of the longitudinal bearing wall panels forming two-storey height bay.
Figure 9:
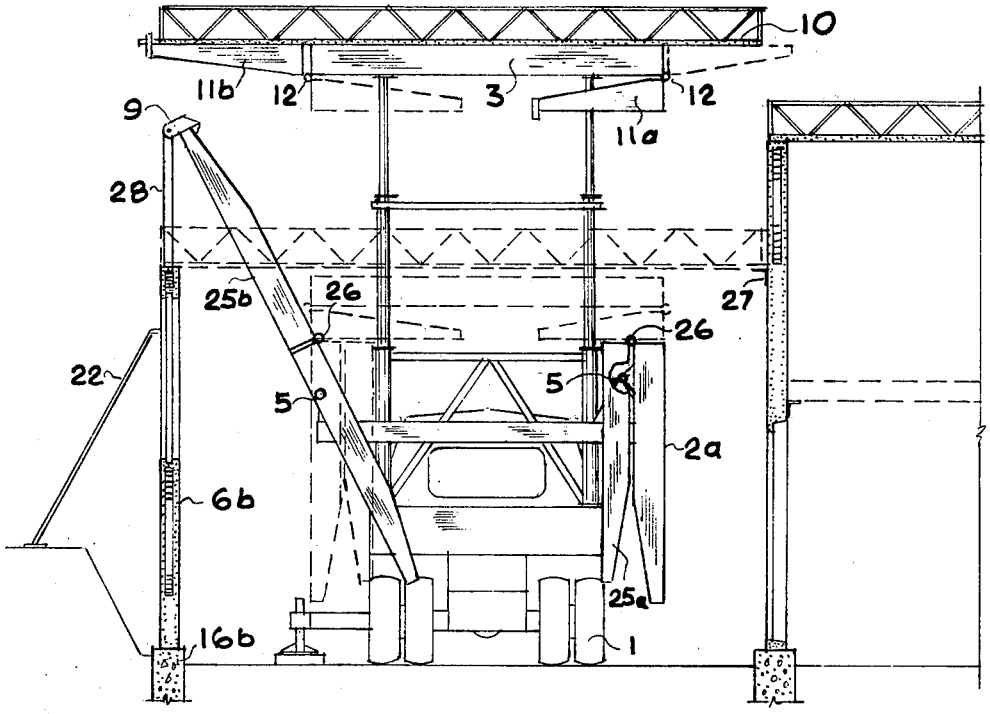
FIG. 9 is a cross-sectional view of the plant type V, showing erection of the longitudinal bearing wall panels forming lower bay of a split-level house.
Figure 10:
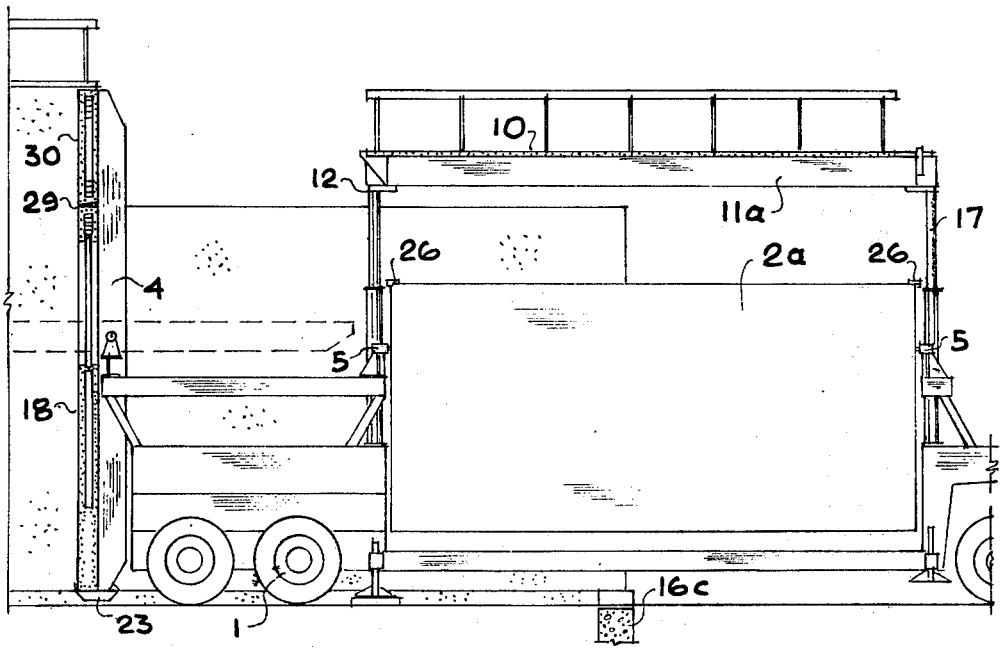
FIG. 10 is a longitudinal sectional view of the plant type V, showing erection of the cross cladding panel at a vertical ledge of a split-level house.

The same setting of the form-erectors is used in the modification of the plant type V, shown in FIGS. 8, 9, and 10.

To erect two-storey height bays, the form-erectors 2a and 2b are extended in the cross direction. Each form-erector has a top (after rotating) folding part 25a or 25b, rotatable around a horizontal axis through hinges 26.

After erection of the wall panels 6a and 6b, the folding parts 25a and 25b are rotated down around the hinges 26 and stay in the vertical position during stripping the lifting form and travelling the plant, as shown in FIG. 9.

The plant can erect buildings, consisting of the bays with different heights, situated both beside each other and along the lengthwise axis of the plant. Erection of the buildings in both cases can be started from the higher bay.

In the first case, shown in FIG. 9, while erecting the lower bay, one of the longitudinal bearing wall panels may be omitted, and the roof slab 10 sits on a support angle 27.

The height of the wall panel 6b is determined by position of the top edge and the length of loops 28.

In the second case, shown in FIG. 10, a horizontal dividing bar 29 is used on the form-erector 4 for producing at once a cladding panel 30, which has been erected at a vertical ledge between the two bays, and the wall panel 18, which is supposed to be erected at a lower bay on the foundation 16c.

I claim:

1. A portable plant for on-site horizontal casting and erecting concrete wall panels and roof slabs of bays with variable widths and heights reaching two storeies to form different types of houses and other buildings, said plant comprising:

a wheeled frame, supporting the casting and erecting equipment;

two rotatable and symmetrically set form-erectors for casting and erecting longitudinal bearing wall panels, said form-erectors being divided by hinges of rotating into two parts, one of which functions during erection as a jib, and the other part being a counterpoise, said form-erectors having the width in the cross direction less than the height of said wall panels and the top in a vertical position lower than the top of said wall panels being erected;

two motionless brackets holding said wall panels during erection, said brackets replacing a detachable edge on each form-erector, which would have become the top edge after rotating;

a lifting form for casting and erecting roof slabs with a flat bottom surface, said form having a hinged part on both longitudinal sides for producing said slabs with extended widths, said parts being folded down before erecting said slab and stripping said form;

a rotatable form-stripper for casting and erecting cross wall panels, said form-stripper having detachable side parts with a movable edge;

a hinged lock bracket for releasing said cross wall panel after fixing, said bracket replacing a detachable edge on said form-stripper, which would have become the bottom edge after rotating; the improvement:

wherein said form-stripper has a hinged part on both sides.

2. A plant as claimed in claim 1, comprising:

said form-erectors having the same width in the cross direction as the height of the wall panels; and said lifting form producing the roof slabs with a special shape of the bottom surface ensuring a gap over said form-erectors being in a vertical position after said slab is erected.

3. A plant as claimed in claim 2, comprising:

said form-erectors with the part functioning as a jib being longer than the part being a counterpoise, thereby said form-erectors rotating back into the horizontal position after the wall panels are erected at appropriate distance, said form-erectors being positioned vertically during travelling of the plant; and said lifting form producing the roof slabs with the flat bottom surface.

4. A plant as claimed in claim 3, comprising:

said form-erectors lapping one over the other and staying in the horizontal position after erection and during travelling of the plant.

5. A plant as claimed in claim 4, comprising:

said form-erectors being extended in the cross direction and each having a folding part being over said hinges of rotation after rotating, said form-erectors being folded after erection and stayed in a vertical position after that;

said form-stripper having a horizontal dividing bar for producing at once a cladding panel for a ledge of a split-level house and a cross wall panel for a lower bay.

* * * * *